United States Patent [19]

Gonzalez et al.

[11] 3,981,501

[45] Sept. 21, 1976

[54] RETRACTIBLE GOAL POST

[76] Inventors: Ray Gonzalez; Roy Gonzalez; Octavio Raymundo Gonzalez, all of 3427 Savannah Ave., El Paso, Tex. 79930

[22] Filed: Dec. 11, 1974

[21] Appl. No.: 531,699

[52] U.S. Cl. ..... 273/55 R

[51] Int. Cl.[2] ..... A63B 67/00

[58] Field of Search ..... 273/55 R, 29 BB, 201; 272/59 R; 49/324, 131, 138, 33, 10; 194/30

[56] References Cited

UNITED STATES PATENTS

| | | | |
|---|---|---|---|
| 1,998,454 | 4/1935 | Gordon | 273/29 BB |
| 2,074,125 | 3/1937 | Lefft et al. | 273/55 R |
| 2,696,985 | 12/1954 | Hogeberg | 273/201 |
| 2,884,252 | 4/1959 | Thompson | 273/55 R |
| 3,301,313 | 1/1967 | Schurkin | 49/334 X |
| 3,649,016 | 3/1972 | Kelley, Jr. | 273/55 R |
| 3,682,476 | 8/1972 | Kempson | 272/59 X |
| 3,699,717 | 10/1972 | Kedrick | 49/334 X |

*Primary Examiner*—Richard C. Pinkham
*Assistant Examiner*—T. Brown
*Attorney, Agent, or Firm*—James J. Brown

[57] ABSTRACT

A retractable goal post device is provided which comprises telescoping upright sections which are retracted when not in use into a casing disposed below ground level with a hinged top cover flush with the surface of the playing field. The top cover can be raised to permit raising and lowering of the goal post but is lowered at other times so as to not interfere with the play on the field. A hydraulic activating device is provided for raising and lowering the goal post and the top cover of the casing. Artificial turf is provided to cover the top cover portion of the casing.

5 Claims, 3 Drawing Figures

RETRACTIBLE GOAL POST

Throughout the history of athletic events such as the game of football severe player injuries have occurred as a result of players' colliding with fixed installation goal posts during the excitement and fever of play. Injuries of this nature are undesirable from two prime standpoints; first, from their crippling effect on player personnel and, secondly, in that they often change the course of a game when a star player must be removed from play because of his injuries.

The current invention provides a device that may be easily installed in the end zone of an athletic playing field that will provide the function of the required goal post, yet which will remove the hazard of goal post injuries caused by inadvertent player goal post collisions. This feature is particularly important to the many players of the game of football and other sports as well as to the future of the game itself in that it will greatly assist in reducing the criticism often voiced by humanitarian groups against games involving physical contact.

In addition to its safety features the present invention materially aids the play of the game directly by providing goal posts that can be extended to such height that the possibility of a misculled field goal or extra point is reduced to a bare minimum. Specifically, the goal post of the present invention may be extended without difficulty to heights of sixty feet or greater to assure that the ball when kicked will definitely pass between two uprights, therefore eliminating any possibility of a poor judgement call on the part of the referees as to whether or not the ball did in fact pass between the uprights.

This invention relates to a new and unique telescopic goal post device that is stowed underground in a retracted position at all times during periods of game play except when needed, thereby reducing player injuries frequently caused by players' inadvertently colliding with fixed position goal post. Further, the goal post device is so constructed that it may be extended at will to allow for plays in which its use as a reference for scoring plays is required.

An important object of this invention is to provide for player safety by removing injury causing devices from the playing area of the athletic field.

Another object of this invention is to provide an efficient and economical means of raising and lowering goal posts on command from remote locations.

A further object of the present invention is to provide a retractible football goal post installation that when retracted is fully retracted in such a manner that the upper surface of the retraction pit is smooth and level with the surrounding terrain and without hazards that may cause players to trip, stumble or become impaled upon installation protrusions.

Yet, another object of this invention is to provide a retractible football goal post installation that will afford a weather shield for the retractible football goal post when it is in the retracted position as well as for the mechanism that effects retraction and extension of the goal post.

A still further object of this invention is to provide a reliable retractible goal post device that will provide fail safe operation so as to preclude the loss of a score due to failure of the goal post to extend at critical moments.

These and other objects are accomplished according to the present invention which comprises a plurality of parallel cylindrical telescopic uprights joined by a horizontal cross bar near the terminus of their upper extremity and being firmly secured at their base by insertion into tubular receptacles. Said receptacles and uprights being interconnected and extended and retracted by hydraulic, electric and mechanical means which allow complete retraction of the uprights within a recessed casing which is complete with a hinged covering device.

The described apparatus, in essence comprises as an entity a set of telescopically retractible goal posts for use on playing fields. Other objects and many of the attendant advantages of this invention will be readily appreciated as the same becomes better understood by reference to the following detailed description when considered in connection with the accompanying drawings wherein.

In the drawings wherein for the purpose of illustration is shown a preferred embodiment of the invention and wherein similar reference characters designate corresponding parts throughout the several views: the complete device is designated (1).

Figure 1:
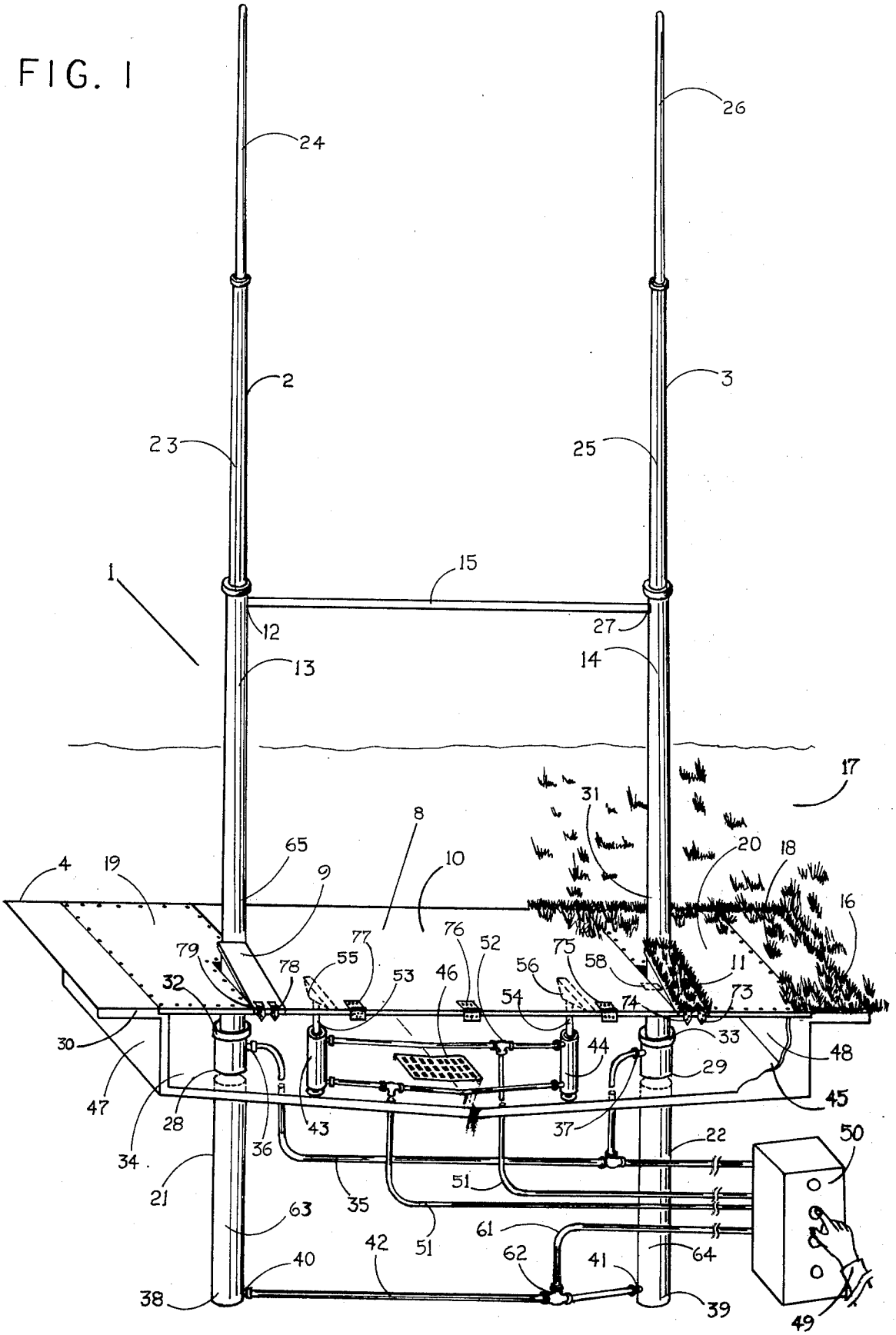
FIG. 1 is a perspective view showing a preferred embodiment of the current invention installed on a football playing field.
Figure 2:
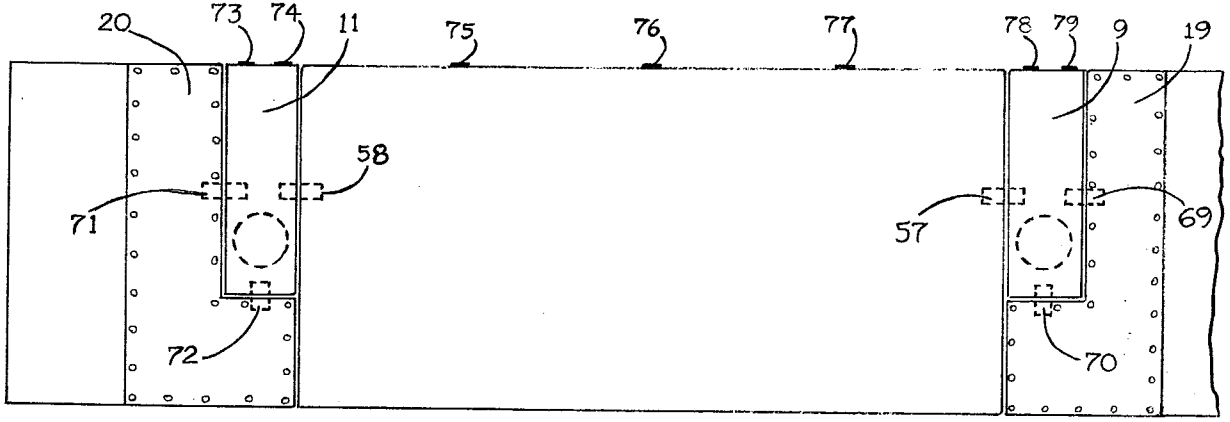
FIG. 2 is a top plan view of the upper surface with the device in a retracted position.

FIGS. 1 and 2. A preferred embodiment of the present invention is shown which comprises a pair of ground mounted hydraulically operated vertically deposed parallel telescopic uprights 2 and 3 which extend perpendicularly through and above a concrete casing 4 exiting said casing vertically through suitable openings 5, 6 and 7 in the casing's top cover 8 which are exposed by the raising of hinged lids 9, 10 and 11. Said uprights 2 and 3 being connected at points 12 and 27 near the upper extremities of their lower telescopic sections 13 and 14 by horizontal cross bar 15 which is perpendicular to the vertical axis of said uprights 2 and 3. The concrete casing 4 is normally poured at the installation site in such a manner that the synthetic grass covering 16 of the casing's hinged lids 9, 10 and 11 are flush with the terrain surface 17 and with the synthetic grass covering 18 of the casing's permanently attached end panels 19 and 20 with the bulk of the casing 4 lying completely below the terrain surface 17.

In FIGS. 1 and 2, the vertical telescopic uprights, the left vertical upright 2 and the right vertical upright 3 are each composed of base receptacles 21 and 22 respectively and three telescoping tubular sections; Sections 13, 23 and 24 comprise the left upright and sections 14, 25 and 26 comprise the right upright. The base receptacles 21 and 22 are firmly and permanently mounted perpendicularly to and through the base of concrete casing 4 at points 28 and 29 near their upper extremities in such a manner that the flanged lips 32 and 33 of said base receptacles 21 and 22 are raised a few inches above the upper surface 34 of the floor 45 of concrete casing 4 so as to allow space for the connection of hydraulic return tube 35 to hydraulic return fittings 36 and 37 respectively. The base receptacles 21 and 22 are further equipped at their lower exprémities 38 and 39 with hydraulic fluid input fittings 40 and 41 to which a hydraulic fluid input tube 42 is attached.

Figure 3:
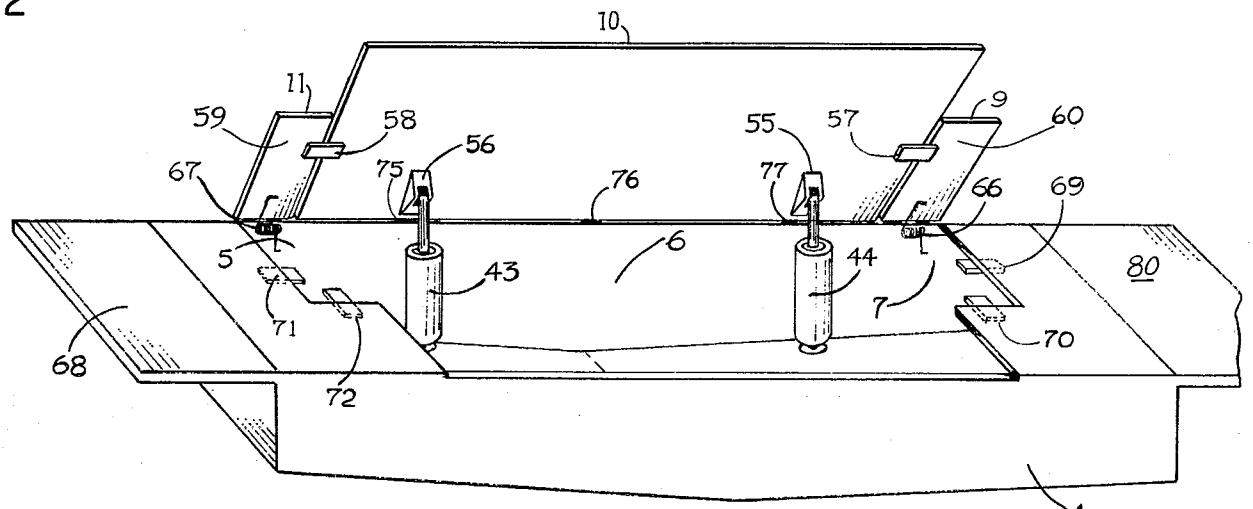
FIG. 3 is a perspective view of the casing which houses the device.

Reference FIGS. 1, 2 and 3, the casing's 4 top cover 8 comprises a plurality of hinged and camed artificial turf 16 covered lids 9, 10 and 11 and two artificial turf 18 covered permanently attached end panels 19 and 20. The hinged and camed arrangement of the lids 9, 10 and 11 in cooperation with two hydraulic lifters 43 and 44 open and close the hinged lids 9, 10 and 11 sequentially to allow the vertical uprights 2 and 3 to telescope without restriction to their extended positions or to fully retract within casing 4 so as to, in essence, fully remove the uprights from the playing area. The artificial turf covered hinged lids 9, 10 and 11 in cooperation with the artificial turf covered permanently attached end panels 19 and 20, when closed, and the artificial turf 16 covered end flanges 68 and 81 of concrete casing 4 further serve to form an uninterrupted playing surface over the terrain installed concrete casing 4 providing as well a weather shield to protect the various components contained within the concrete casing 4.

The floor 45 on concrete casing 4, in addition to serving as a mounting base for hydraulic lifters 43 and 44 and for base receptacles 21 and 22, contains a grated sump 46 to allow for the free drainage of water or other liquids that might seep into the casing 4. To facilitate drainage, the floor 45 of said casing is angularly inclined downward approximately 5° from its end walls 47 and 48 toward the grated sump 46 which is installed at the low point of the floor's incline.

The operational sequence of extension and retraction of the vertical uprights 2 and 3 and their contiguous cross bar 15 is initiated by remote operator 49 manipulating console controls 50 so as to cause a flow of pressurized fluid through appropriate tubing 51 and connections 52 into hydraulic lifters 43 and 44, thereby causing the arms 53 and 54 of said lifters 43 and 44 to extend upward. Upward extension of lifters arms 53 and 54 is transmitted to the activating lid 10 through appropriate swivel linkage 55 and 56, thus causing the activating lid 10 which is hinged to concrete casing 4 by strap hinges 75, 76 and 77 to swing upward and outward in an arc in a direction toward the length of the playing field, thus creating an opening 6 in the casing 4 above the retracted cross bar 15. During the initial rise of the activating lid 10 two cams 57 and 58 which are permanently fixed to the activating lid 10 contact hinged lids 9 and 11 simultaneously on their lower surfaces 59 and 60 respectively, thus causing said lids to swing upward and outward in unison with the activating lid 10, thereby creating openings 5 and 7 in casing 4 above the vertical uprights 2 and 3. All three lids, the activating lid 10 and its two satellite lids 9 and 11 continue their upward and outward swing until they are approximately vertical with the terrain surface where further movement is prevented by automatic stops within hydraulic lifters 43 and 44. The remote operator 49, upon observing the vertical position of the activating lid 10 and its two satellite lids 9 and 11, manipulates appropriate controls on the control console 50 so as to cause a flow of pressurized fluid through appropriate tubing 61 and connections 62 into the lifting chambers 63 and 64 of telescopic uprights 2 and 3, thus causing said uprights and their contiguous cross bar 15 to extend vertically through opening 5, 6 and 7 created by the upward and outward swing of lids 9, 10 and 11 to the full amount of their allowable travel. Once the vertical uprights 2 and 3 are fully extended, the remote operator 49 manipulates appropriate controls which effects the removal of hydraulic fluids from hydraulic lifters 43 and 44, thus effecting retraction of lifter arms 53 and 54 and subsequent lowering of activating lid 10 until it recontacts the edges of the upper surface of the casing 4. Upon lowering of the activating 10, the satellite lids 9 and 11 are lowered by gravitational pull and spring tension provided by springs 66 and 67 and follow the activating lid 10 downward until they rest angularly upon the outer walls 65 and 31 respectively of the extended uprights 2 and 3 where they remain until the uprights are again retracted into casing 4. To retract the vertical uprights 2 and 3 the remote operator 49 first manipulates appropriate controls on the control console 50 to cause activating lid 10 to rise upward and outward toward the length of the playing field. When the activating lid 10 reaches a point in its rise that is equal to the angular displacement of the inclined lids 9 and 11, activating lid cams 57 and 58 contact respectively the lower surfaces 59 and 60 of satellite lids 9 and 11 respectively, thus lifting said lids from their position of rest against the outer walls 65 and 31 of vertical uprights 2 and 3 and again carrying them throughout its full swing to a point approximately eighty degrees from the horizontal. Once the three lids 9, 10 and 11 are at the apex of their swing the remote operator 49 hydraulically retracts the vertical uprights fully within the casing 4 whereupon he hydraulically lowers the activating lid 10 to its full down position. The vertical uprights 2 and 3 being fully retracted within the casing 4 do not interfere with the downward movement satellite lids 9 and 11. Therefore, said lids follow the downward tract of the activating lid fully, by gravitational pull and spring tension, until all lids 9, 10 and 11 lie flush each to the other and parallel to the terrain 17 to form the upper surface 30 of casing 4, thus forming a continuous playing surface over the buried casing 4.

Supports 71 and 72 which are permanently attached to the lower surface of end panel 20 cooperate with strap hinges 73 and 74 to provide support for and to maintain vertical alignment of panel 11 with abutting panels of the top cover 8 when said panels are in the down position. Similarly, supports 69 and 70 which are permanently attached to the lower surface of end panel 19 cooperate with strap hinges 78 and 79 to provide support for and to maintain vertical alignment of panel 9 with abutting panels of the top cover 8.

It is to be understood that while the detailed drawings and specific examples given describe preferred embodiments of the invention they are for the purposes of illustration only; that the apparatus of the invention is not limited to the precise details and conditions disclosed, and that various changes may be made therein without departing from the spirit of the invention which is defined by the following claims.

What is claimed is:

1. An extendible and retractable goal post device comprising two parallel and spaced apart vertically disposed goal posts connected by a horizontal member, each vertical post comprising an elongated bottom member and at least two coaxially telescoping tubes telescoping within said bottom member, each vertical post being extendible to vertically adjust said horizontal member to regulation goal post cross member height; the bottom end of each bottom member being mounted below ground level in a first hydraulic means, said hydraulic means cooperating to raise said post vertically to a fully extended position above ground level and to withdraw said post to a retracted position completely below ground level; said horizontal member extending between the upper end of each bottom member and being connected thereto; said device further comprising a subterranean casing means for housing said goal posts and said horizontal member in their retracted position, said casing means being provided with hydraulically activatible hinged lid means at ground level, said lid means being adapted to be raised to a substantially vertical position by a second hydraulic lifting means to permiit entry and exit of said goal posts and horizontal member into and from said casing and further being adapted to be lowered to a position flush with the ground; said lid means providing a covering for said casing when said goal posts and horizontal member are retracted or extended.

2. The device of claim 1 wherein said hinged lid means comprises a relatively larger central hinged portion disposed between said vertical goal posts and capable of being raised to a nearly vertical position or lowered to a horizontal position by said second hydraulic lifting means without interfering with said vertical posts, and two relatively smaller, independently hinged lid means disposed on either side of said central hinged portion to cover said vertical posts in their retracted position, said independently hinged means being adapted to be raised to a nearly vertical position by means attached to said central portion but independently partially retractable to a position to accommodate the vertically extended posts.

3. The device of claim 1 wherein said lid means is covered with artificial turf.

4. The device of claim 1 wherein lack of said hydraulic means are remotely operated.

5. The device of claim 1 wherein said casing means is provided with drainage means.

* * * * *